United States Patent [19]

Smith

[11] Patent Number: 4,525,715

[45] Date of Patent: Jun. 25, 1985

[54] TOROIDAL COUPLED TELEMETRY APPARATUS

[75] Inventor: Harrison C. Smith, Richardson, Tex.

[73] Assignee: Tele-Drill, Inc., Richardson, Tex.

[21] Appl. No.: 571,644

[22] Filed: Jan. 18, 1984

Related U.S. Application Data

[63] Continuation of Ser. No. 324,924, Nov. 25, 1981, abandoned.

[51] Int. Cl.[3] ..... G01V 1/40

[52] U.S. Cl. ..... 340/854; 340/855; 33/312; 175/50

[58] Field of Search ..... 243/185

[56] References Cited

U.S. PATENT DOCUMENTS

| | | | |
|---|---|---|---|
| 2,354,887 | 8/1944 | Silverman et al. | 340/856 |
| 2,379,800 | 7/1945 | Hare | 340/854 |
| 2,389,241 | 11/1945 | Silverman | 340/856 |
| 2,411,698 | 11/1946 | Silverman et al. | 340/856 |
| 2,414,719 | 1/1947 | Cloud | 340/854 |
| 3,186,222 | 6/1965 | Martin | 340/854 |
| 4,302,757 | 11/1981 | Still | 340/854 |

*Primary Examiner*—Nelson Moskowitz

*Attorney, Agent, or Firm*—John J. Byrne; Bradford E. Kile

[57] ABSTRACT

A logging telemetering system comprising a toroidal coupled telemetry apparatus including a primary winding carrying bore hole data, wrapped around at last one torroid core mounted within a drill collar. The toroid core is further wrapped with at least one secondary turn which is connected to the drill collar for enhancing the efficiency of inducing a current carrying the borehole data in the drill string for transmission to the surface. One half turn of the secondary winding is provided by an insulated portion of the drill collar, and the balance of the secondary winding is composed of an electrically conductive strap wound around the toroid core.

2 Claims, 5 Drawing Figures

24
20
26
28
30
34
32
36
46
50
42
44
48
38
50
40

TOROIDAL COUPLED TELEMETRY APPARATUS

This application is a continuation of application Ser. No. 06/324,924, filed Nov. 25, 1981, now abandoned.

CROSS REFERENCE TO RELATED APPLICATIONS

This application is related to the following commonly assigned applications: (1) application Ser. No. 230,035, filed Jan. 30, 1981, by Llewellyn A. Rubin and entitled "Toroidal Coupled Telemetry Apparatus" and (2) application Ser. No. 323,563, filed Nov. 20, 1981 as a continuation of the foregoing application, and now abandoned.

BACKGROUND OF THE INVENTION

This application relates to an apparatus for facilitating measuring bore hold data and for transmitting the data to the surface for inspection and analysis. Although the subject invention may find substantial utility at any stage in the life of a borehole, a primary application is in providing real time transmission of large quantities of data simultaneously while drilling. This concept is frequently referred to in the art as downhole measurements-while-drilling or simply measurements-while-drilling (MWD).

The incentives for downhole measurements during drilling operations are substantial. Downhole measurements while drilling will allow safer, more efficient, and more economic drilling of both exploration and production wells.

Continuous monitoring of downhole conditions will allow immediate response to potential well control problems. This will allow better mud programs and more accurate selection of casing seats, possibly eliminating the need for an intermediate casing string, or a liner. It also will eliminate costly drilling interruptions while circulating to look for hydrocarbon shows at drilling breaks, or while logs are run to try to predict abnormal pressure zones.

Drilling will be faster and cheaper as a result of real time measurement of parameters such as bit weight, torque, wear and bearing condition. The faster penetration rate, better trip planning, reduced equipment failures, delays for directional surveys, and elimination of a need to interrupt drilling for abnormal pressure detection, could lead to a 5 to 15% improvement in overall drilling rate.

In addition, downhole measurements while drilling may reduce costs for consumables, such as drilling fluids and bits, and may even help avoid setting casing too early. Were MWD to allow elimination of a single string of casing, further savings could be achieved since smaller holes could be drilled to reach the objective horizon. Since the time for drilling a well could be substantially reduced, more wells per year could be drilled with available rigs. The savings described would be free capital for further exploration and development of energy resources.

Knowledge of subsurface formations will be improved. Downhole measurements while drilling will allow more accurate selection of zones for coring, and pertinent information on formations will be obtained while the formation is freshly penetrated and least affected by mud filtrate. Furthermore, decisions regaring completing and testing a well can be made sooner and more competently.

There are two principal functions to be performed by a continuous MWD system: (1) downhole measurements, and (2) data transmission.

The subject invention pertains to the data transmission aspect of MWD. In the past several systems have been at least theorized to provide transmission of downhole data. These prior systems may be descriptively characterized as: (1) mud pressure pulse, (2) insulated conductor, (3) acoustic and (4 ) electromagnetic waves.

In a mud pressure pulse system the resistance to the flow of mud through a drill string is modulated by means of a valve and control mechanism mounted in a special drill collar sub near the bit.

The communication speed is fast since the pressure pulse travels up the mud column at or near the velocity of sound in the mud, or about 4,000 to 5,000 fps. However, the rate of transmission of measurements is relatively slow due to pulse spreading, modulation rate limitations, and other disruptive limitations such as the requirement of transmitting data in a fairly noisy environment.

Insulated conductors, or hard wire connection from the bit to the surface, is an alternative method for establishing down hole communications. The advantages of wire or cable systems are that: (1) capability of a high data rate; (2) power can be sent down hole; and (3) two way communication is possible. This type of system has at least two disadvantages; it requires a special drill pipe and it requires special tool joint connectors.

To overcome these disadvantages, a method of running an electrical connector and cable to mate with sensors in a drill collar sub was devised. The trade off or disadvantage of this arrangement is the need to withdraw the cable, then replace it each time a joint of drill pipe is added to the drill string. In this and similar systems the insulated conductor is prone to failure as a result of the abrasive conditions of the mud system and the wear caused by the rotation of the drill string. Also, cable techniques usually entail awkward handling problems, especially during adding or removing joints of drill pipe.

As previously indicated, transmission of acoustic or seismic signals through a drill pipe, mud column, or the earth offers another possibility for communication. In such systems an acoustic (or seismic) generator would be located near the bit. Power for this generator would have to be supplied downhole. The very low intensity the signal which can be generated downhole, along with the acoustic noise generated by the drilling system, makes signal detection difficult. Reflective and refractive interference resulting from changing diameters and thread makeup at the tool joints compounds the signal attenuation problem for drill pipe transmission. Moreover signal-to-noise limitations for each acoustic transmission path are not well defined.

The last major previously known technique comprises the transmission of electromagnetic waves through a drill pipe and the earth. In this connection electromagnetic pulses carrying downhole data are input to a toroid positioned adjacent a drill bit. A primary winding, carrying the data for transmission, is wrapped around the toroid and a secondary is formed by the drill pipe. A receiver is connected to the ground at the surface where the electromagnetic data is picked up and recorded.

In some previously known drillstring toroid designs the secondary is composed of one turn formed by a mud carrying central mandrel of the drillstring and collar and mud flow around the outside of the drillstring in the drilling annulus, which also appears as the secondary's load. Another type of drillstring toroid design, in which the secondary is composed of an electrically conductive member wrapped repeatedly around an annular core member, is disclosed in commonly assigned application Ser. No. 230,035, filed Jan. 30, 1981, by Llewellyn A. Rubin and entitled "Toroidal Coupled Telemetry Apparatus."

One difficulty with previously known systems has been the amount of power needed to transmit the data carrying signals to the surface. In this connection MWD toroids are mounted within the side walls of the drill collar adjacent the drill bit which may be thousands of feet beneath the earth's surface. In addition the amount of space available for batteries within a drill collar is limited. Moreover the amount of space available for toroid cores and windings is limited. Accordingly it would be highly desirable to be able to increase the efficiency by which a data carrying current could be induced into a drill string for transmission to the surface. It would further be desirable to provide a toroidal coupled MWD system operable to transform data carrying primary current to a secondary efficiently, while presenting a reasonable load impedance to the transmitter.

The problems and unachieved desires set forth in the foregoing are not intended to be exhaustive but rather are representative of the severe difficulties in the art of transmitting borehole data. Other problems may also exist but those presented above should be sufficient to demonstrate that room for significant improvement remains in the art of transmitting borehole data.

In the above connection, notwithstanding substantial economic incentives, and significant activity and theories by numerous interests in the industry, applicant is not aware of the existence of any commercially available system for telemetering, while drilling, substantial quantities of real time data (as compared with the subject application) from a borehole to the surface.

OBJECTS OF THE INVENTION

It is therefore a general object of the invention to provide a novel apparatus for use in a system to advantageously telemeter large quantities of real time data from a borehole to the surface.

It is a particular object of the invention to provide a toroidal coupled, data transmission apparatus wherein the normal functioning of a conventional drill collar is not disrupted such that normal well activity can be realized simultaneously with transmitting borehole data to the surface.

It is a further object of the invention to provide a novel toroidal coupled telemetry apparatus operable to increase the efficieny of inducing a data carrying current into a drill collar.

It is another object of the invention to provide a novel toroidal coupled telemetry apparatus wherein the efficiency of transforming primary current to a secondary is increased.

BRIEF SUMMARY OF THE INVENTION

A preferred form of the invention which is intended to accomplish at least some of the foregoing objects comprises a toroidal coupled telemetry apparatus including a primary winding carrying borehole data, wrapped around at least one toroid core mounted within a drill collar. The toroid core is further wrapped with at least one secondary turn which is connected to the drill collar for enhancing the efficiency of inducing a current carrying the borehole data into the drillstring for transmission to the surface. One half turn of the secondary winding is provided by an insulated portion of the drill collar, and the balance of the secondary winding is composed of an electrically conductive strap wound around the toroid core.

THE DRAWINGS

Other objects and advantages of the present invention will become apparent from the following detailed description of a preferred embodiment thereof taken in conjunction with the accompanying drawings, wherein.

DETAILED DESCRIPTION

Figure 1:
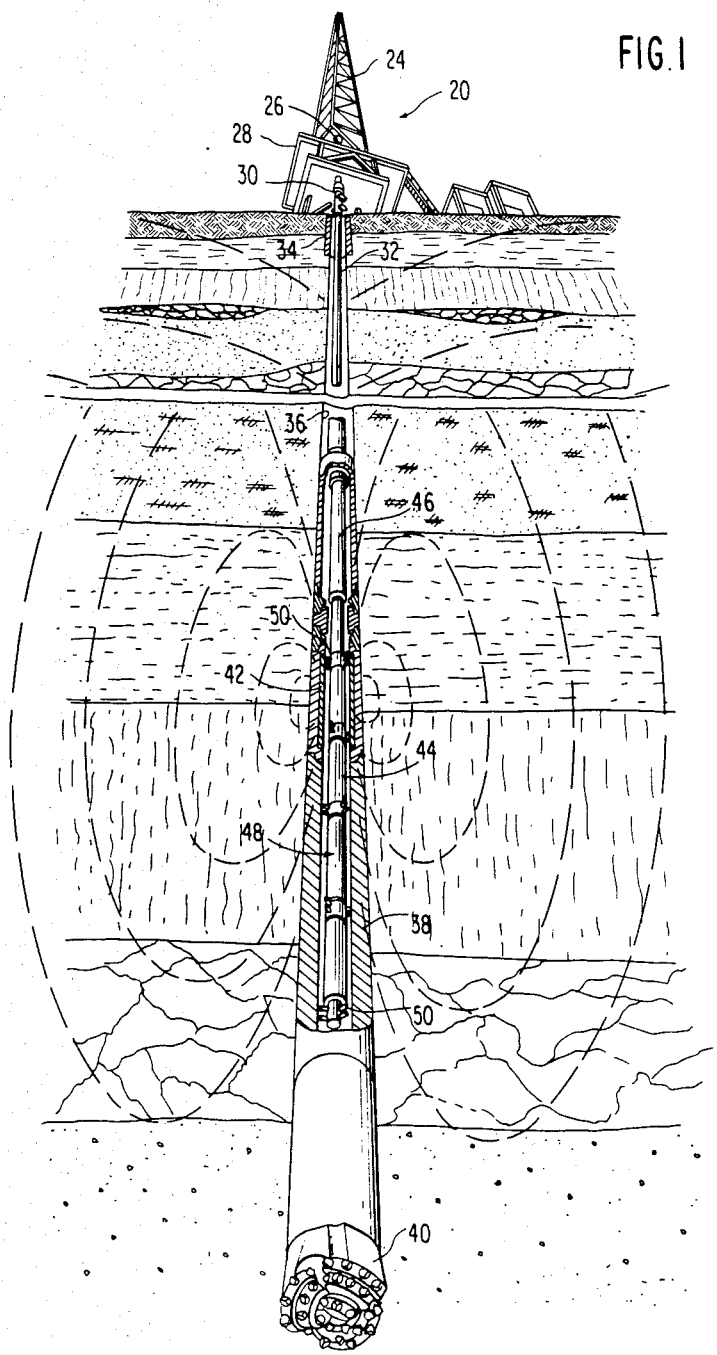
FIG. 1 is a perspective view from the downhole end of a drill string disclosing a drill collar and a toroidal coupled MWD system for continuously telemetering real time data to the surface.

Referring now to the drawings, wherein like numerals indicate like parts, there will be seen various views of a toroidal coupled, MWD telemetry system in accordance with a preferred embodiment of the subject invention.

Context of the Invention

Before providing a detailed description of structural aspects it may be worthwhile to outline the context of the instant invention. In this connection and with reference to FIG. 1 there will be seen a conventional rotary rig 20 operable to drill a borehole through variant earth strata. The rotary rig 20 includes a mast 24 of the type operable to support a traveling block 26 and various hoisting equipment. The mast is supported upon a substructure 28 which straddles annular and ram blowout preventors 30. Drill pipe 32 is lowered from the rig through surface casing 34 and into a borehole 36. The drill pipe 32 extends through the borehole to a drill collar 38 which is fitted at its distal end with a conventional drill bit 40. The drill bit 40 is rotated by the drill string, or a submerged motor, and penetrates through the various earth strata.

The drill collar 38 is designed to provide weight on the drill bit 40 to facilitate penetration. Accordingly such drill collars typically are composed with thick side walls and are subject to severe tension, compression, torsion, column bending, shock and jar loads. In the subject system, the drill collar further serves to enhouse a data transmit toroid 42 comprising a winding core for a downhole data telemetering system. Finally the subject drill collar 38 also functions as a support to hand a concentrically suspended telemetering tool 44 operable to detect and transmit downhole data to the surface concomitantly with normal operation of the drilling equipment.

The telemetering tool 44 is composed of a number of sections in series. More specifically a battery pack 46 is followed by a sensing and data electronics transmission section 48 which is concentrically maintained and electrically isolated from the interior of the drill collar 38 by a plurality of radially extending fingers 50 composed of a resilient dielectric material.

Figure 2:
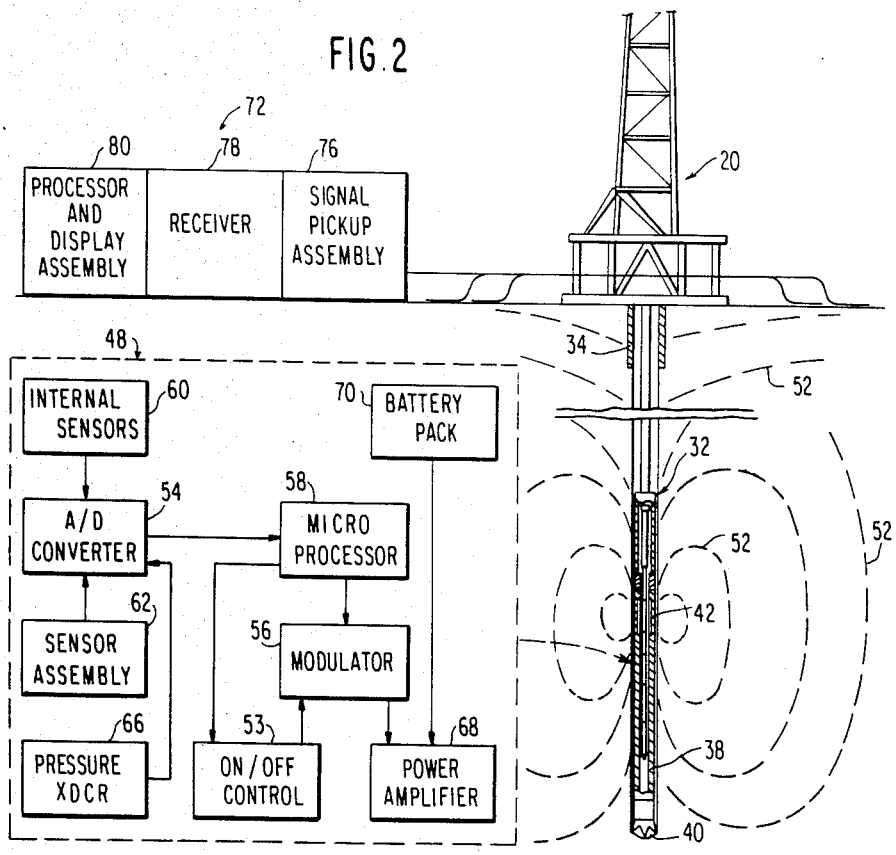
FIG. 2 is a schematic view of the MWD telemetering system disclosed in FIG. 1 including a block diagram of a downhole electronic package which is structurally placed within the drill collar and an uphole signal pickup system.
Figure 3:
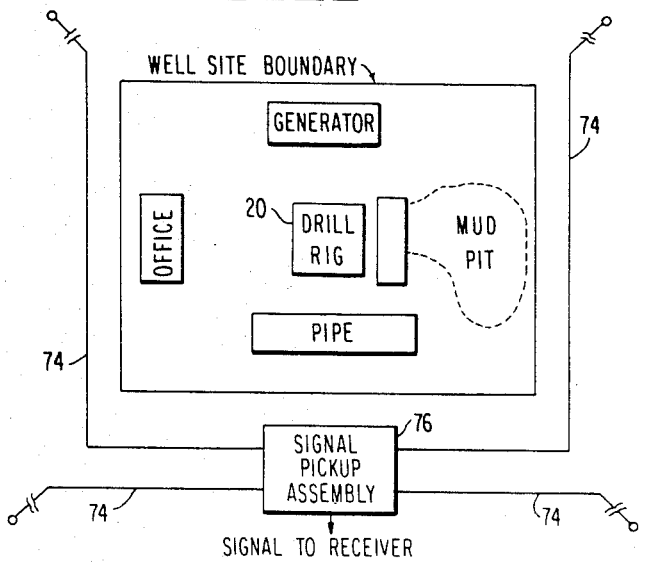
FIG. 3 is a plan view of the uphole system for picking up MWD data signals.

Turning now to FIGS. 2 and 3, there will be seen system diagrams for a toroidal coupled MWD telemetry system. In this system drill bit, environmental and/or formation data is supplied to the tool data electronics sections 48. This section includes an on/off control 53, an A/D converter 54, a modulator 56 and a microprocessor 58. A variety of sensors 60, 62 etc. located throughout the drill string supply data to the electronics section 48.

Upon receipt of a pressure pulse command by pressure transducer 66, or expiration of a time-out unit, whichever is selected, the electronics unit will power up, obtain the latest data from the sensors, and begin transmitting the data to a power amplifier 68.

The electronics unit and power amplifier are powered from nickel cadmium batteries in battery pack 70 which are configured to provide proper operating voltage and current.

Operational data from the electronics unit is sent to the power amplifier 68 which establishes the frequency, power and phase output of the data. The data is then shifted into the power amplifier 68. The amplifier output is coupled to the data transmit toroid 42 which electrically approximates a large transformer wherein the drill string 32 is the secondary.

The signals launched from the toroid 42 are in the form of electromagnetic wave fronts 52 traveling through the earth. These waves eventually penetrate the earth's surface and are picked up by an uphole system 72.

The uphole system 72 comprises radially extending receiving arms 74 of electrical conductors. These conductors are laid directly upon the ground surface and may extend for three to four hundred feet away from the drill site. Although the generally radial receiving arms 74 are located around the drilling platform, as seen in FIG. 3, they are not in electrical contact with the platform or drill rig 20.

The radial receiving arms 74 intercept the electromagnetic wave fronts 52 and feed the corresponding signals to a signal pickup assembly 76 which filters and cancels extraneous noise which has been picked up, amplifies the corresponding signals and sends them to a low level receiver 78.

A processor and display system 80 receives the raw data output from the receiver, performs any necessary calculations and error corrections and displays the data in a usable format.

Toroidal Coupled Telemetry Structure

Figures 4, 5:
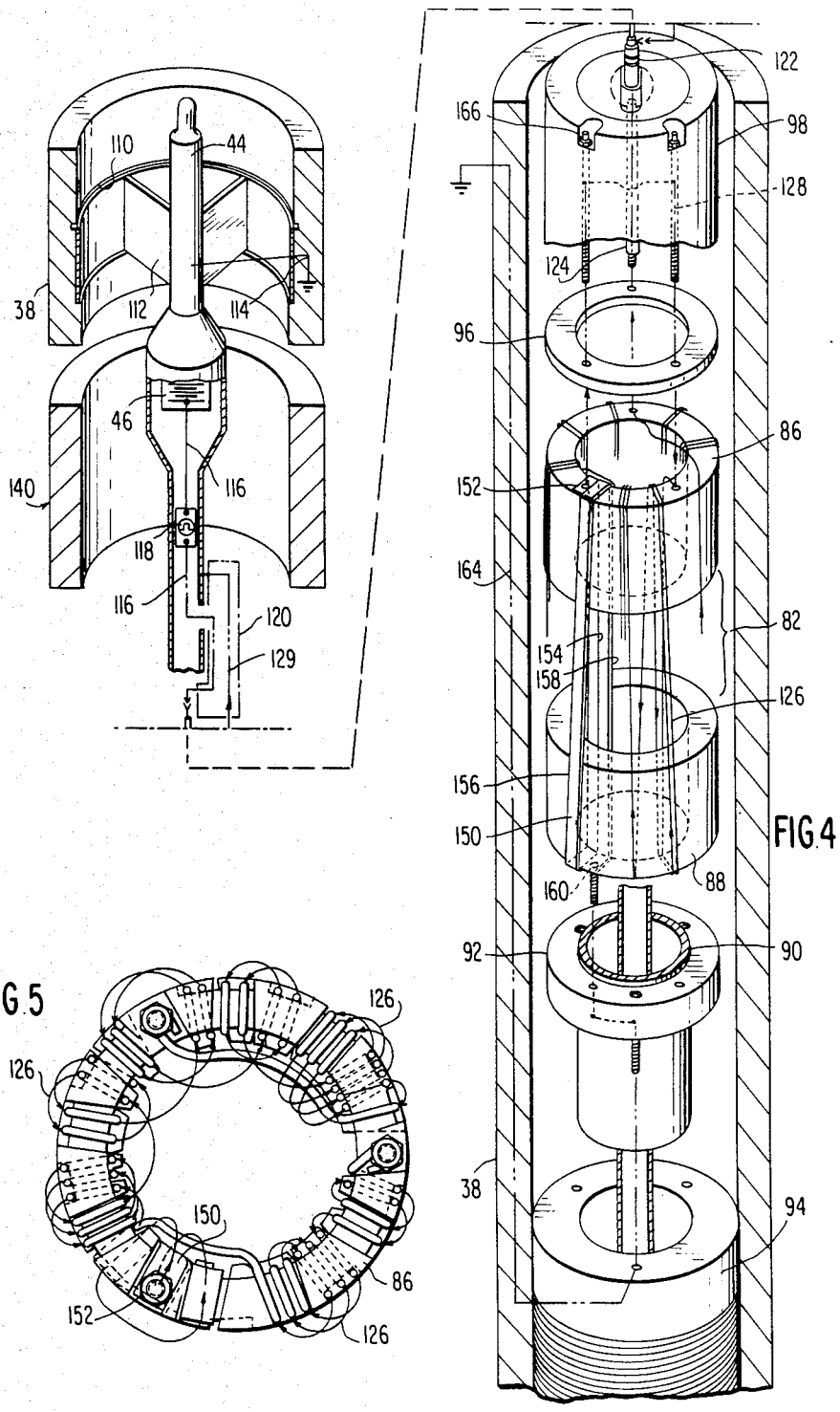
FIG. 4 is an exploded, schematic view of a toroid unit in accordance with the subject invention including a schematic representation of an insulated gap sub assembly.
FIG. 5 is a plan view of the toroid wiring system in accordance with a preferred embodiment of the invention.

Referring now to FIGS. 4 and 5 there will be seen partially detailed partially schematic views of the previously noted data transmit toroid assembly 42 comprising the subject invention. The toroid assembly is composed of one or more cylindrical members or collars which are positioned in area 82. The words "toroid" and "toroidal" are terms of art in the industry and refer to cylindrical structures as opposed to the strictly accurate geometrical definition of a body generated by rotation of a circle. An upper termination block 86 and lower termination block 88 illustrates the configuration of the intermediate toroids. The cylindrical toroid cores are composed of a ferromagnetic material such as silicon steel, permalloy, etc. The termination blocks are composed of fiberglass with an insulation coating and serve to hold the intermediate toroid cores in position and provide end members to receive toroid windings.

The toroid package is mounted about a mandrel 90 which extends up through the toroid collars. In FIG. 4, however, the mandrel is broken away to better illustrate the windings of the toroid. The mandrel 90 has a radially extending flange 92 which rests upon and is bolted to a bottom sub 94 connected to the drill collar. A similar support arrangement, not shown, is provided above an insulated space ring 96 and an electrical connector block assembly 98 to fixedly secure and join the toroid section 42 to the drill collar 38. In substance thereby the toroid becomes a part of the drill collar and drilling mud flows in an uninterrupted path through the center of mandrel 90 to permit a continuous drilling operation.

As previously indicated a telemetering tool 44 is designed to be positioned within the drill collar 38 and hangs from the drill collar by a landing connector 110 having radial arms 112 connected to an upper portion of the tool 44.

The battery pack 46 is schematically shown encased within an upper segment of tool 44. A negative of the battery pack is connected to the tool 44 which is in direct electrical communication with the drill collar 38 and drill pipe 34, note the schematic representation at 114. The positive terminal of the battery pack 46 extends along line 116 to a data source schematically depicted at 118. The downhole data to be transmitted is input to the toroid system at this point. The line 116 then feeds into an electrical connector guide, schematically shown at 120. The guide may be a spider support arrangement which the tool slides into to establish an electrical couple between line 116 and electrical connector 122. The line 116 then passes through a cylindrical insulation sleeve 124 and connects directly to a first end of a primary winding 126 of the toroid assembly 42. The primary winding 126 is wrapped a number of times around the toroid core members, as shown. For reasons explained hereinafter, the primary winding 126 is preferably wrapped around the toroid core 18 times. The second end of the toroid primary 126 extends through the electrical connector block housing 98 at 128 and connects to an outer sheath of the electrical connector 122 which is in communication with the tool outer sheath through line 129 and thus back to ground in the drill collar at 114.

The secondary of the toroid transmit system is composed of the drill collar 38 and drill string 32. In order to prevent a short turn through the drill collar, it is necessary to provide an insulated zone as schematically shown at 140 in series with the drill collar. As previously indicated, however, the drill collar must also be structurally rugged and capable of withstanding tremendous down-hole forces of tension, compression, torque, column bend, vibration and jarring on a sustained basis, in order to provide a normal drilling function. Various embodiments of insulated drill collar sub sections, operable to advantageously isolate the toroid secondary are disclosed in United States McDonald et al. application for patent Ser. No. 229,800, filed Jan. 30, 1981, and entitled "Insulated Drill Collar Gap Sub Assembly For A Toroidal Coupled Telemetry System".

This application is of common assignment herewith. The disclosure of the McDonald et al. application is hereby incorporated by reference as though set forth at length.

Returning now to FIGS. 4 and 5, there will be seen a secondary winding on the cylindrical toroid cores in accordance with the subject invention. More specifically, a first end of the secondary winding 150 is attached to mounting point 152 on the upper termination block 86. The secondary winding 150 extends from the mounting point 152 along the interior of the toroid core collars, note segment 154, up along the outside of the core collars, note segment 156, down the interior again, note segment 158, and terminates on the lower termination block 88, at a mounting point 160. The secondary winding 150 thus is wrapped one and one half turns aroung the toroidal core collars.

The mounting point 160 is directly connected to the mandrel flange 92 which is mounted on the toroid bottom sub 94. The bottom sub is in direct electrical contact with the outer sheath of the drill collar 38 which is electrically integral up to the insulated zone 140. Accordingly a second outer one-half turn is provided for the secondary winding 150 by the outer sheath of the drill collar 38 as indicated by line 164 in FIG. 4. This configuration has been found to be extremely beneficial in minimizing the number of turns of the secondary winding 150 which must be passed through the annular gap between the core segments and the drill collar.

The second end of the secondary winding 150 is connected to the drill collar above the insulated gap sub 140. In this connection a mounting pin 166 extends through the connector block housing 98 and is in direct electrical contact with the first end of the secondary winding 150 at point 152. The pin 166 is electrically connected through the connector block housing to the outer sheath of the electrical connector 122. Connector 122, in turn, is in electrical communication with the tool outer sheath and the drill collar above the insulated zone 140 as previously described in connection with the primary winding 126.

As previously stated, the primary winding 126 preferably comprises 18 turns, and the secondary winding 150 preferably comprises 2 turns, giving a turn ration of 9/1. This ratio has been determined to be the most efficient for transmitting downhole data to the surface. Moreover, it has been determined that enhanced operative results are obtained in the instant environment of a downhole measurements-while-drilling too if the first one and one-half turns of the secondary winding 150 are composed of an electrically conductive strap.

SUMMARY OF MAJOR ADVANTAGES OF THE INVENTION

After reviewing the foregoing description of the preferred embodiments of the invention, in conjunction with the drawings, it will be appreciated by those skilled in the art that several distinct advantages are obtained by the subject invention.

Without attempting to detail all of the desirable features specifically and inherently set forth above, a major advantage of the invention is the provision of a toroidal coupled telemetry system wherein multiple turns are applied to the secondary. This significantly reduces the volume of high-permeability iron required to transfer power. For example, the shortest practical toroid for 5 Hz, 100 watts, and a load of 0.05 ohms is approximately 40 feet in length. By using two secondary turns, the same efficiency can be attained in a unit only 10 feet long.

Another significant aspect of the subject invention is the utilization of the drill collar sheath as half a turn of the secondary. Moreover, utilizing a strap secondary provides distinct operative advantages in the subject environment. Still further it has been determined that a turns ration of 9/1 provides enhanced results for the subject measurements-while-drilling downhole tool.

In describing the invention, reference has been made to preferred embodiments. Those skilled in the art, however, and familiar with the disclosure of the subject invention, may recognize additions, deletions, modifications, substitutions and/or other changes which will fall within the purview of the subject invention as defined in the claims.

I claim:

1. In a downhole toroidal coupled telemetry apparatus for telemetering downhole measurements-while-drilling information from a drill collar of an operating drill string within a wellhole to the surface of the earth by launching electromagnetic signals into the earth bulk and picking up said signals, transmitted through the earth, at the surface of the earth at one or more locations adjacent to but spaced from the drill string, said toroidal coupled telemetry apparatus comprising:

an axially elongated annular core of magnetic-permeability coaxially mounted interiorly within the wall of the drill collar of the drill string;

a plurality of primary electrical conductor windings axially wrapped around the exterior surface of said annular core, said primary electrical conductor windings extending axially around said annular core interiorly within the wall of the drill collar of the drill string;

means positioned within said drill collar for imputing a variable electric current to said primary windings, said current being operable to carry downhole data sensed simultaneously with and during a drilling operation; and an electrically insulated zone within the sidewall of the drill collar for providing electrical isolation between two areas of the sidewall of the drill collar; wherein the improvement comprises:

secondary electrical conductor winding means at least partially axially wrapped around the exterior surface of said annular core for receiving variable electrical signals induced by said primary electrical conductor windings and carrying downhole data to be transmitted to the surface of the earth, said secondary electrical conductor winding means comprising one-and-one-half turns of an electrical conductor axially wrapped around the exterior surface of said annular core, said electrical conductor being electrically connected at one end directly to the drill collar on one side of said electrically insulated zone within the sidewall of the drill collar and electrically connected at the other end directly to the drill collar on the other side of said electrically insulated zone remote from said electrically insulated zone such that the drill collar comprises the last one-half turn of a two-turn secondary electrical conductor winding means wherein electrical signals from said secondary electrical conductor means carrying downhole data will be electromagnetically launched into the earth bulk surrounding the drill collar and transmitted to the surface by electromagnetic waves through the earth and picked up at the surface of the earth at one or more locations adjacent to but spaced from the drill string.

2. A downhole toroidal coupled telemetry apparatus as defined in claim 1 wherein, the ratio of turns in the primary electrical conductor windings to turns in the secondary electrical conductor winding means, including the last one-half turn in the secondary electrical conductor winding means formed by the drill collar, is 9-to-1.

* * * * *